US009220937B2

(12) United States Patent
Wagner

(10) Patent No.: US 9,220,937 B2
(45) Date of Patent: Dec. 29, 2015

(54) INERTING METHOD AND DEVICE FOR EXTINGUISHING A FIRE

(75) Inventor: Ernst Werner Wagner, Winsen (DE)

(73) Assignee: Amrona AG, Zug (CH)

( * ) Notice: Subject to any disclaimer, the term of this patent is extended or adjusted under 35 U.S.C. 154(b) by 2300 days.

(21) Appl. No.: 10/584,117

(22) PCT Filed: Dec. 29, 2004

(86) PCT No.: PCT/EP2004/014903
§ 371 (c)(1),
(2), (4) Date: May 10, 2007

(87) PCT Pub. No.: WO2005/063338
PCT Pub. Date: Jul. 14, 2005

(65) Prior Publication Data

US 2009/0126949 A1 May 21, 2009

(30) Foreign Application Priority Data

Dec. 29, 2003 (EP) ..... 03029928

(51) Int. Cl.
*A62C 2/00* (2006.01)
*A62C 8/00* (2006.01)
*A62C 35/00* (2006.01)
*A62C 99/00* (2010.01)

(52) U.S. Cl.
CPC ..... *A62C 99/0018* (2013.01); *A62C 99/0009* (2013.01)

(58) Field of Classification Search
CPC ..... A62C 99/0018; A62C 99/0009
USPC ..... 169/46, 45, 47, 49, 69, 67, 16, 43; 239/208, 209
See application file for complete search history.

(56) References Cited

U.S. PATENT DOCUMENTS 3,012,613 A * 12/1961 Diquattro ..... 169/9
3,844,354 A * 10/1974 Larsen ..... 169/46
5,128,881 A * 7/1992 Saum et al. ..... 702/51

(Continued)

FOREIGN PATENT DOCUMENTS

CN 1533814 A 10/2004
DE 42 36 544 5/1994
DE 4236544 A1 * 5/1994 ..... A62C 37/00
EP 1 103 286 5/2001

(Continued)

*Primary Examiner* — Len Tran
*Assistant Examiner* — Steven M Cernoch
(74) *Attorney, Agent, or Firm* — Fraser Clemens Martin & Miller LLC; James D. Miller

(57) ABSTRACT

The present invention relates to an inerting method for extinguishing a fire in a closed room in which the oxygen content in the closed room is reduced to a specific inerting level within a given time (x), as well as a device for carrying out the method. In order to achieve the most exacting design possible to the inert gas fire-extinguishing system used during the inerting method, and in particular the most precise dimensioning possible to the inert gas to be provided, while simultaneously adhering to the required fire-fighting stage and re-ignition prevention stage necessary when extinguishing fires, the invention provides for the inerting level to be kept to the re-ignition prevention level within a given regulation range.

20 Claims, 6 Drawing Sheets

(56) References Cited

U.S. PATENT DOCUMENTS

Figure 1:
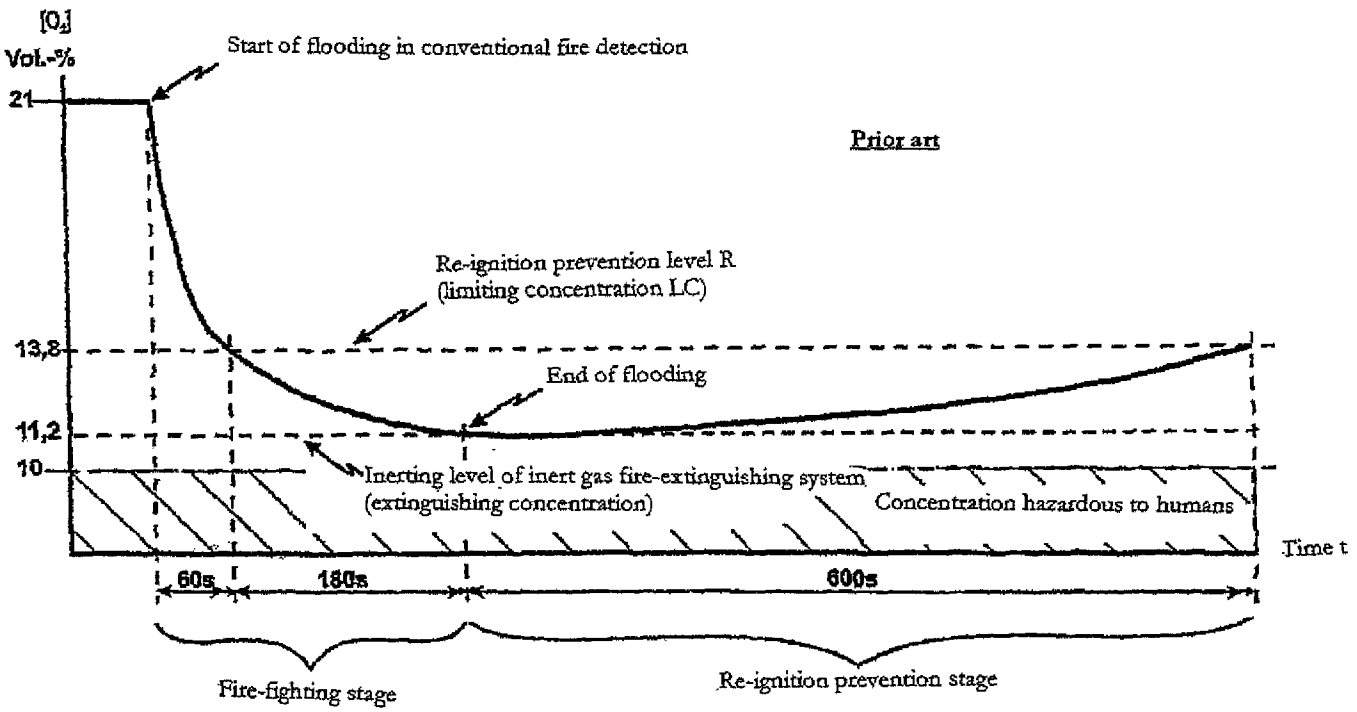

| | | | | |
|---|---|---|---|---|
| 6,029,751 | A * | 2/2000 | Ford et al. | 169/60 |
| 6,082,464 | A * | 7/2000 | Mitchell et al. | 169/43 |
| 6,095,251 | A * | 8/2000 | Mitchell et al. | 169/43 |
| 6,257,341 | B1 * | 7/2001 | Bennett | 169/85 |
| 6,341,572 | B1 * | 1/2002 | Howell et al. | 114/230.12 |
| 2002/0040940 | A1 * | 4/2002 | Wagner et al. | 239/208 |
| 2002/0070035 | A1 * | 6/2002 | Grabow et al. | 169/16 |
| 2003/0136879 | A1 * | 7/2003 | Grabow et al. | 244/129.2 |

FOREIGN PATENT DOCUMENTS

| | | | | |
|---|---|---|---|---|
| EP | 1103286 | A1 * | 5/2001 | A62C 39/00 |
| RU | 2066217 | C1 | 9/1996 | |
| RU | 2201775 | C1 | 4/2003 | |
| RU | 2212262 | C2 | 9/2003 | |
| UA | 74822 | C2 | 9/2003 | |
| WO | 02055155 | A1 | 7/2002 | |

* cited by examiner

INERTING METHOD AND DEVICE FOR EXTINGUISHING A FIRE

The invention relates to an inerting method for extinguishing a fire in a closed room (also referred to as "target area" in the following), whereby the oxygen content in the closed room is reduced within a given time to a specific inerting level, as well as a device for carrying out said method, wherein the device comprises at least one oxygen/inert gas sensor for continuously measuring the oxygen content and/or the inert gas content in the target area; at least one fire detector for detecting at least one fire parameter in the target area; an inert gas mechanism for inerting the target area with an oxygen-displacing inert gas; and a control/regulating means for controlling the inert gas mechanism such that after detecting a fire parameter, the oxygen concentration in the target area is lowered to a specific inerting level by the inerting of the target area.

Lowering the oxygen concentration in a relevant area to an average value of approximately 12% by volume is known with respect to fighting fires in closed rooms. At this oxygen concentration, most flammable materials will no longer ignite. The extinguishing effect this method yields is based on the principle of oxygen displacement. As is commonly known, normal ambient air consists of oxygen at 21% by volume, nitrogen at 78% by volume and 1% by volume of other gases. The extinguishing process discharges pure nitrogen as an inert gas into the relevant area, for example, to further increase the nitrogen concentration, thus reducing the percentage of oxygen. An extinguishing effect kicks in when the percentage of oxygen drops below approximately 15% by volume. Depending on the flammable materials in the relevant area, further lowering the percentage of oxygen to, for example, the cited 12% by volume may be necessary.

With this "inert gas fire-extinguishing method," as the flooding of a room containing an incipient or already burning fire with oxygen-displacing gas such as carbon dioxide, nitrogen, inert gases or mixtures thereof is referred to, the oxygen-displacing or inert gases are either stored under pressure in steel cylinders or produced as needed by means of a generator. In the event of a fire, the gas is conducted into the relevant target area through a system of pipes and corresponding outlet nozzles.

The temporal sequence of fighting a fire when utilizing an inerting method is essentially divided into two stages, the fire-fighting stage and the re-ignition prevention stage. The fire-fighting stage is that phase during which the target area is flooded with an oxygen-displacing gas in order to attain a concentration of supplied inert gas capable of extinguishing the fire in the target area. According to the VdS, the concentration capable of extinguishing fire is defined as that concentration at which fire can be excluded with certainty. The extinguishing concentration is lower than that of the so-called re-ignition prevention level and corresponds, for example in EDP areas, electrical switching and distributor areas, closed installations as well as stock inventory areas storing economic goods, to an oxygen concentration of approximately 11.2% by volume.

The VdS (Verband der Schadenversicherer—Association of Property Insurers) indicates that the oxygen concentration must reach a so-called re-ignition prevention level within 60 seconds of starting the area flooding in the fire-fighting stage. The re-ignition prevention level is an oxygen concentration at which a (renewed) igniting of the materials accommodated within the target area can only just be excluded. The oxygen concentration at the re-ignition prevention level is a function of the target area's fire load and is, for example in EDP areas, electrical switching and distributor areas, closed installations as well as inventory areas storing economic goods, an oxygen concentration of approximately 13.8% by volume.

The stipulation that the oxygen concentration must reach a re-ignition prevention level within 60 seconds of the fire-fighting stage determines the slope to the profile specifying the flooding profile for the inert gas fire-extinguishing system or the inerting method at the beginning of the fire-fighting stage. The inert gas fire-extinguishing system and the inerting method should be configured accordingly.

Subsequent the fire-fighting stage comes the so-called re-ignition prevention stage during which the fire in the target area is completely extinguished. The re-ignition prevention stage is a period of time during which the oxygen content is not allowed to rise above the re-ignition prevention level; i.e. above the cited 13.8% by volume, for example. The VdS guidelines indicate that the re-ignition prevention stage is to last more than ten minutes. In other words, this means that the inert gas fire-extinguishing system and the inerting method need to be designed such that after a fire is detected, the target area is flooded with inert gas so as to attain an oxygen concentration in the target area at the re-ignition prevention level within 60 seconds, whereby this concentration is furthermore not to be exceeded during the fire-fighting stage and the re-ignition prevention stage.

FIG. 1 shows the flooding profile for an inert gas fire-extinguishing system based on a conventional inerting method using the example of a target area equipped with EDP equipment. According to the VdS guidelines, the re-ignition prevention level determined here from testing is an oxygen concentration of 13.8% by volume; this concentration is occasionally also referred to as the "limiting concentration." The extinguishing concentration, a combination of the source material for the fire, an area-specific parameter and a safety factor, is at 11.2% by volume in FIG. 1 and thus still 1.2% by volume above the 10% by volume level hazardous to humans and animals. In the inerting methods known from the prior art, the extinguishing concentration corresponds to the inerting level of the inert gas fire-extinguishing system.

In the depicted example, the inert gas fire-extinguishing system employed, the inerting method respectively, is designed such that within 60 seconds after a fire having been detected, the inerting method triggered respectively, the re-ignition prevention level (13.8% by volume) is reached by discharging or flooding the target area with inert gas. It is thereby provided for the oxygen concentration to continue to drop after reaching the re-ignition prevention level until it reaches the 11.2% by volume extinguishing concentration, the inerting level of the inert gas fire-extinguishing system respectively. At this point in time, the fire in the target area is completely extinguished and since flooding the target area with inert gas ceases after the inerting level, the extinguishing concentration respectively, is reached, the oxygen concentration in the target area increases continuously in the subsequent re-ignition prevention stage (due to target area porosity).

It would now be conceivable to set the time frame for exceeding the re-ignition prevention level by means of the "depth" to the inerting level for the inert gas fire-extinguishing system. Yet since the room's air-tightness allows the increasing, the sloping curve profile respectively, to the oxygen concentration in the target area during the re-ignition prevention stage, the time point of exceeding the re-ignition prevention level (the 13.8% by volume) can only be adjusted by the settings for the extinguishing concentration or by establishing the inerting level for the inert gas fire-extinguishing system. In the present case, with an 11.2% by volume extinguishing concentration, the re-ignition prevention level will not be exceeded until 600 seconds after the fire-fighting stage ends.

The disadvantage to the inerting procedures for extinguishing a fire in a target area as known from the prior art and described above is that lowering the oxygen concentration to the inerting level of the inert gas fire-fighting system during the fire-fighting stage must essentially be to clearly below the re-ignition prevention level in order to not have the re-ignition prevention level be exceeded prematurely after the end of the fire-fighting stage and to ensure that the re-ignition prevention stage is sufficiently long enough. Hence, the inerting procedures known in the art require the providing of clearly larger amounts of extinguishing agent than would ultimately be necessary for fighting the fire. This presupposes the provision of, for example, large-sized pressure relief valves and additional space for the gas cylinders in which the inert gas is stored in compressed form. Because of the necessary oversizing to the systems known in the art, the inerting method for extinguishing a fire is relatively costly.

A further disadvantage to the inerting methods known in the art can be seen in that there is no possibility of preventing the oxygen concentration in the target area from prematurely exceeding the re-ignition level after the end of the fire-fighting stage. This is however necessary, for example, should for instance the air-tightness of the target area not correspond to the design value. Such a case is not improbable since the entry of fresh air; i.e. flows which exceed the limits of the protected room, can occur due to, for example, unexpected seepage in the external structural components of the target area or due to a malfunctioning of the ventilation/air conditioning systems installed in the target area. Such unexpected seepage cannot be taken into account when appraising room air-tightness in the designing of the corresponding inerting method and, in the event of fire, lead to an insufficient extinguishing effect when employing the method.

The present invention thus addresses the technical problem of providing an inerting method for extinguishing a fire of the type discussed above by means of which the inert gas fire-extinguishing system used with the inerting method can be designed as exactingly as possible, in particular the most precise dimensioning possible to the inert gas to be provided, while simultaneously complying with the required fire-fighting stage and re-ignition prevention stage involved in extinguishing fires. A further task of the present invention consists of providing an appropriate device to realize the inerting method developed.

In terms of the method, this task is solved by an inerting method of the type specified at the outset in that the inerting level is kept to a certain level within a given regulation range, in particular the re-ignition prevention level. It is hereby expressly pointed out that the inventive method is not limited to the special case of the inerting level being held to the re-ignition prevention level as established, for example, by the VdS (Association of Property Insurers). The given specific level rather concerns a previously-defined level which advantageously coincides with or approaches the re-ignition prevention level.

The technical problem underlying the present invention is further solved by a device for carrying out the above-cited method which has at least one oxygen/inert gas sensor for continuously measuring the oxygen content and/or the inert gas content in the target area; at least one fire detector for detecting at least one fire parameter in the target area; an inert gas mechanism for inerting the target area with an oxygen-displacing inert gas; and a control/regulating means for controlling the inert gas mechanism such that after detecting a fire parameter, the oxygen concentration is lowered in the target area to a specific inerting level by inerting the target area, whereby in accordance with the invention, the control/regulating means regulates the inerting level to a specific level within a given regulation range, in particular the re-ignition prevention level specific to the target area, and namely by correspondingly controlling the inert gas means dependent on the oxygen content and/or inert gas content as continuously measured by the at least one oxygen/inert gas sensor.

The particular advantage to the invention is in its achieving of a simple to realize and thereby very effective method of optimizing the flooding profile of an inert gas fire-extinguishing system. Because the re-ignition prevention stage provided for extinguishing a fire can be adjusted in accordance with the invention by means of regulating the inerting level, the inerting level set during the fire-fighting stage no longer limits the time of the re-ignition prevention stage. In other words, this means that the inerting level set during the fire-fighting stage can correspond to an oxygen concentration in the target area which no longer needs to be clearly below the re-ignition prevention level, as is the case in conventional inerting procedures known in the art. Thus, clearly less extinguishing agent is needed for the overall flooding process during the inerting method according to the invention, whereby the inerting method and associated inert gas fire-extinguishing system are designed and adapted precisely to the target area. In particular, there is no need to store large quantities of inert gas in storage containers. With the method according to the invention, and in particular by regulating the inerting level to the re-ignition prevention level, there is advantageously no overmodulation of the inert gas concentration in the target area during the re-ignition prevention stage. Because clearly less extinguishing agent is needed with the method according to invention and there is no overmodulation of the inert gas concentration in the target area, any pressure relief valves which may be provided in the target area can also be dimensioned smaller. The invention furthermore provides for a certain regulation range in which the inerting level is kept to the re-ignition prevention level. This regulation range is dependent on, for example, the air-tightness of the target area and/or the design of the inert gas fire-extinguishing system, the sensitivity of the sensors used in the target area to ascertain the oxygen concentration respectively.

The device according to the invention provides a possibility for carrying out the above-described method. Here the re-ignition prevention stage provided for extinguishing a fire is set by means of regulating the inerting level with the control/regulating means regulating the inerting level within a specific regulation range to the re-ignition prevention level specific to the target area. This ensues by correspondingly controlling the inert gas mechanism dependent on the oxygen content and/or inert gas content as continuously measured by the at least one oxygen/inert gas sensor. The term "inert gas mechanism" is hereby to be understood as an inert gas reservoir and/or a system for producing an oxygen-displacing inert gas, for example nitrogen or $CO_2$.

Further embodiments of the invention are indicated in the subclaims.

A particularly preferred embodiment of the inerting method according to the present invention thus provides for the inerting level to correspond to the re-ignition prevention level. It thereby becomes advantageously possible to adapt the dimensioning and/or design of the inert gas fire-extinguishing system very exactingly to the target area (air-tightness, volume, possible fire source materials). Thus, in this preferred embodiment of the inventive inerting method, the regulating of the inerting level in the target area to the re-ignition prevention level occurs while still in the fire-fighting stage. Because during the entire flooding process the inert gas concentration in the target area never at any time exceeds the re-ignition prevention level beyond the regulation range, and in particular because a clear overshooting of the inert gas concentration in the target area is thus prevented, this in principle realizes only needing to use the precise amount of inert gas during the initial flooding as is actually necessary to extinguish the fire. Thus, the storage containers for storing the inert gas can be dimensioned clearly smaller, respectively the appropriate system to produce the inert gas as, for example, a nitrogen system, can be designed correspondingly smaller. It is hereby expressly pointed out that the re-ignition prevention level can be made dependent on the target area or other contingencies; in particular, it is not solely limited to the re-ignition prevention level as established for example by the VdS (Association of Property Insurers).

In order to ensure that the re-ignition prevention level is at no time exceeded during the fire-fighting stage and the re-ignition prevention stage, an especially advantageous embodiment of the inventive inerting method provides for the upper threshold of oxygen content in the regulation range being smaller than or, at maximum, equal to the re-ignition prevention level. The term "threshold" in conjunction hereto designates the remaining oxygen concentration with which the inert gas fire-extinguishing system is switched back on and/or the inert gas reintroduced into the target area in order to keep the inerting level to the target value, or to re-establish same. Activating the inert gas fire-extinguishing system then introduces the oxygen-displacing gas into the target area from, for example, an inert gas reservoir or production equipment. In a particularly preferred case, when the upper threshold of the oxygen content in the regulation range is distanced from the re-ignition prevention level, there is an additional certain factor of safety. This safety reflects the difference between the re-ignition prevention level and the upper threshold. It is pointed out in conjunction hereto that a certain factor of safety has usually already been taken into account in the re-ignition prevention level. The lower end of the regulation range is limited by a lower threshold. This lower threshold corresponds to the oxygen concentration at which the inert gas fire-extinguishing system is switched off or the re-introduction of oxygen-displacing gas in the target area is stopped.

A particularly advantageous realization of the latter embodiment provides for the amplitude of the oxygen content in the regulation range having a height of approximately 0.2% by volume, and preferably a maximum height of 0.2% by volume. Accordingly, the amplitude to the range of remaining oxygen concentration between the connect and cut-off threshold for the inert gas fire-extinguishing system is approximately 0.4% by volume and preferably a maximum of 0.4% by volume. Of course, other amplitudes for the oxygen content within the regulation range are also conceivable here.

It is particularly preferred for the regulating of the oxygen content to the re-ignition prevention level to ensue with consideration of the air exchange rate of the target area, especially in consideration of the $n_{50}$ value of the target area and/or the pressure difference between target area and environment. The air exchange rate designates the relationship of the leakage volume flow in relation to the given spatial volume with a generated 50 Pa pressure difference to the environment. In other words, this means that the air exchange rate is a measure of the air-tightness of the target area and thus a crucial measure in dimensioning the inert gas fire-extinguishing system. With increasing dimension to the $n_{50}$ value, the porosity volume flow into or out of the measured target area rises. The fresh air gains into the room and the inert gas losses out of the room thereby increase. Both result in the inert gas fire-extinguishing system needing to be designed with greater efficiency. The air-tightness to the target area's respective external limiting structural components is accomplished with a so-called BlowerDoor measurement. The intent thereby is to create a standardized positive/negative pressure of from 10 to 60 Pa. Air escapes outward through porous areas of the external structural components or infiltrates inward at these points. An appropriate measuring instrument measures the volume flow needed to maintain the required pressure difference for measuring e.g. 50 Pa. After entering carrier values, the analysis program calculates the $n_{50}$ value for the room, which is standardized to the generated pressure difference of 50 Pa. Such a BlowerDoor measurement is to ensue prior to the actual dimensioning of the inert gas fire-extinguishing system, the inerting method respectively, at the latest however before placing the system into operation. By the inventive consideration of the target area's $n_{50}$ air exchange rate, further improved adapting of the dimensioning of the inert gas fire-extinguishing system and the inerting method to the target area can be advantageously achieved.

So as to optimally dimension the inert gas reservoir and/or the production system to the target area, the calculation of the extinguishing agent quantity for lowering the oxygen content to the inerting level and for holding the oxygen content to the re-ignition prevention level preferably ensues with due consideration of the target area's air exchange rate, in particular with consideration of the target area's $n_{50}$ value and/or the pressure difference between target area and environment.

In a particularly preferred realization of the inerting method according to the invention, in which lowering the oxygen content takes place via feeding of an oxygen-displacing gas into the target area, it is particularly preferable to take the air/gas pressure in the target area into consideration when regulating the supply of oxygen-displacing gas. Accordingly, the pressure in the target area is measured during the flooding with inert gas or oxygen-displacing gas, whereby care is taken not to exceed a specific room pressure. This then becomes apparent in that the rise to the slope; i.e., the rise in the concentration profile for the inert gas introduced in the target area immediately after the triggering of the inert gas fire-extinguishing system, is adapted to specific parameters of the target area such as air-tightness and volume. In order to not inflate the target area during flooding, which would have an increased consumption of fire-extinguishing agent as the consequence, the profile shape is kept correspondingly flatter as circumstances prescribe, so that the inerting level is not reached after 60 seconds, for example, but a short time later as in about 120 or 180 seconds. By regulating the fire-extinguishing agent supply under consideration of the air/gas pressure in the target area, the inventive inerting method can in particular also be used in target areas which have no fixed walls or in which no pressure relief valves or similar mechanisms can be installed.

In a further preferred realization of the inerting method according to the invention, in which lowering the oxygen content takes place via feeding an oxygen-displacing gas into the target area, it is particularly preferable to provide for a regulating of the supply of oxygen-displacing gas in dependence on the target area's current oxygen content, current fire-extinguishing agent concentration respectively. Conceivable here would be, for example, measuring the oxygen content in the area when nitrogen is being used as the extinguishing agent. When, however, $CO_2$ is used as the extinguishing agent, the $CO_2$ concentration is preferably measured in the target area in order to regulate the feed of oxygen-displacing gas.

In realizing the inerting method according to the invention by lowering the oxygen content via supplying an oxygen-displacing gas, it is advantageous for the regulation of the oxygen-displacing gas feed to ensue in dependence on the oxygen content prior to beginning the lowering of the oxygen content to the specific inerting level. It is therefore conceivable, for example, that in a case in which the oxygen content prior to lowering is at 21% by volume, supplying of the oxygen-displacing gas will occur faster than in another case in which the oxygen content prior to lowering is at, for example, 17% by volume. The inventive embodiment is, however, not limited to this specific case, same only being cited here as an example.

A particularly preferred embodiment of the inerting method according to the invention in which lowering the oxygen content takes place via feed of an oxygen-displacing gas, and in which there is a regulating of the supply of the oxygen-displacing gas, provides for this regulating of the feed of the oxygen-displacing gas being effected pursuant a specific, for example previously-defined flooding trajectory. Conceivable here would be, for example, controlling the appropriate valves which regulate the feed of the oxygen-displacing gas such that either the flooding profile; i.e., the temporal development of the oxygen concentration in the target area and/or the temporal development of the oxygen-displacing gas concentration in the target area corresponds to a specific pattern. The advantage to this embodiment is in particular to be seen in that an ideal flooding of the target area can be adapted to the inerting system and/or the target area without needing to continuously monitor the target area oxygen concentration, oxygen-displacing gas concentration respectively, during the flooding. Of course, other possibilities are also conceivable here for regulating the oxygen-displacing gas feed according to a specific flooding trajectory. The opening and/or closing of the valves can, for example, be controlled based on calculations dependent on the current oxygen content or the current extinguishing agent concentration in the target area or in dependence on the air/gas pressure in the target area.

Particularly preferred in an embodiment of the inerting method according to the invention is presetting the time (x) for lowering the oxygen content to the inerting level. This time setting made in advance can, for example, be made by a dimensioning of the fire-extinguishing system which is adapted to a target area and/or by a correspondingly adapted dimensioning of the valves for regulating the feed of oxygen-displacing gas. This then allows the fulfilling of specific guidelines for fire-extinguishing systems, for example the guidelines for $CO_2$ fire-extinguishing systems as prescribed by the VdS.

Another embodiment of the inerting method according to the invention in contrast provides for selecting the time for lowering the oxygen content to the inerting level being dependent on the base inertization level at the time the flooding begins. This is particularly of advantage when the flooding of the target area with inert gas is regulated, and especially in dependence of the existing pressure in the target area. The inventive inerting method is thus particularly flexible in terms of individual case-by-case circumstances, particularly the dimensioning of the fire-extinguishing system as well as the fire load and/or dimensioning of the target area.

One possible realization of the inerting method according to the invention provides for the oxygen content in the target area to be lowered by introduction of an oxygen-displacing gas from a reservoir kept ready for the purpose. Providing the inert gas in a reservoir, for instance in appropriate gas tanks, allows for rapid adjusting of the inerting level in the target area. Conceivable as oxygen-displacing gases are, for example, carbon dioxide, nitrogen, inert gases and mixtures thereof which can be stored compressed or uncompressed in steel cylinders in a separate inert gas reservoir (e.g. suspended ceiling). As needed, the gas will then be fed into the target area through the corresponding piping and associated exhaust nozzles. The advantage to lowering the oxygen content in the target area by introducing an inert gas from a ready reservoir, in which the inert gas is stored in compressed form, is in particular also to be seen in that in addition to the oxygen displacement effect, expansion of the compressed gas additionally adds a positive cooling effect to the extinguishing effect since the expansion enthalpy of the oxygen-displacing gas stored in compressed form is extracted directly from the environment and in particular the target area.

In an alternative embodiment of the inerting method according to the invention, the oxygen-displacing gas is provided by a production system. It would also be alternatively conceivable here to use an apparatus such as, for instance fuel cells, in order to extract oxygen from the target area. The advantage to this embodiment is especially to be seen in that there is then no need to provide separate storage areas, for example reservoirs or gas cylinders for storing the oxygen-displacing gas. One possible realization of a production system for oxygen-displacing gas would be, for example, a nitrogen generator in which the pressurized components are separated and discharged so as to produce a nitrogen flow. Same has a very low pressure dew point and a fixed residual oxygen content which can be continuously monitored. The nitrogen flow gained from the nitrogen generator is fed to the target area through a system of pipes, while the oxygen-enriched air is separately vented off into the open. The advantage to such a production system is particularly to be seen in its comparatively maintenance-free operation. Of course, other methods for producing the oxygen-displacing gas are also conceivable.

Finally, a particularly advantageous embodiment of the inerting method according to the invention provides for the oxygen-displacing gas for lowering the oxygen content to the specific inerting level to be provided from a reservoir and the oxygen-displacing gas to keep the inerting level at the re-ignition prevention level to be provided from a production system. However, it would be just as conceivable for the oxygen-displacing gas needed to lower the oxygen content to the specific inerting level and the gas needed to hold the inerting level to the re-ignition prevention level to be provided from a reservoir and/or a production system.

A further embodiment of the inventive inerting method in which the re-ignition prevention level is a function of the characteristic fire load for the target area, especially as determined in dependence on the materials accommodated within the target area, provides for an optimal adapting of the method to the respective target area in order to advantageously enable a designing to the inert gas fire-extinguishing system employed by the inerting method which is as exact as possible, and in particular the most exact dimensioning to the inert gas to be provided as possible, while concurrently complying with the necessary fire-fighting stage and re-ignition prevention stage necessary in extinguishing a fire. Assuming a ship's engine room as the target area, for example, in consideration of diesel and fuel oils as being characteristic fire loads, the re-ignition prevention level is then determined at a value of, for example, R=17 vol. % $O_2$. On the other hand, in an EDP area (as a further example of a conceivable target area), the electrical cables and plastics determine the applicable re-ignition prevention level for this target area and yield a lower value of, for example, R=13.8 vol. % $O_2$.

In a case in which the target area accommodates running equipment and/or machines, it is of advantage in terms of maintaining operational reliability for the re-ignition prevention level to be determined as a function of the equipment and/or machines and their operating states so as not to cause an uncontrolled complete failure of the equipment and/or machines when flooding the target area with inert gas. If, for example, a fuel-driven power generator runs in the target area, the air supply of which flows into the target area, it is then absolutely imperative to avoid the re-ignition prevention level falling below that of the necessary oxygen content for ignition of the air/fuel mixture in the generator's combustion chamber since otherwise the generator, and the generating of electrical energy, would fail.

A further embodiment of the inerting method according to the invention provides for bringing any equipment and/or machines which may be accommodated within the target area into a specific pre-defined operational state prior to lowering the oxygen content to the specific inerting level. As also with the latter embodiment cited, this advantageously serves in maintaining operational reliability. Assuming a ship's engine room as the target area, for example, it is conceivable with respect to minimizing the air exchange in the engine room in the event of a fire to first, for example, power down the marine engine to a small load (for example 20% to 40%) prior to performing the inventive inerting method. This thus allows the ship's maneuverability as well as generating of power to be maintained. In another case, in which a computer center is assumed as the target area, the advantageous embodiment of the invention provides for first shutting down the EDP units and starting back-up units, for example, before flooding the target area with inert gas. In combination with the latter advantageous embodiment of the invention cited, it is further conceivable that the re-ignition level (among other things) is made a function of the pre-defined operational state in which the equipment and/or machines are set in the case of fire.

In a particularly advantageous realization of the inerting method according to the invention, early fire detection is provided so that lowering the oxygen content in the target area begins right at the moment of early fire detection. It is thereby possible to begin the initial flooding of the target area up to 90 seconds earlier than with conventional fire detection methods, in the process of which the oxygen content in the target area is lowered to a specific inerting level within the given time.

An advantageous embodiment of the device in accordance with the present invention provides for the control/regulating mechanism to comprise a memory with a table in which predefined re-ignition prevention levels dependent on the target area's equipment and/or machines and their operational states are stored. This thus enables automatic fire-fighting with a process controlled specific to the target area, whereby as a consequence of the exact design to the inert gas fire-extinguishing system used with the inerting method and as a consequence of the exact dimensioning to the inert gas to be provided, an especially effective fire-fighting process is enabled, and one in which care is taken to maintain operational reliability. Of course, other embodiments are also conceivable here in providing the control/regulating mechanism for target area-specific re-ignition prevention levels.

A further advantageous embodiment of the inventive device provides for the at least one fire detector for detecting at least one fire parameter in the target area being a detector for early fire detection. Such sensors are known in the art such as, for example, smoke, heat, flame or fume detectors, to allow an early and efficient detection of fire or smoke. The signals recorded by these sensors for detecting smoke, fumes, dust, mist, oil mist and aerosols can moreover be preprocessed. Apart from these sensors providing early fire detection, additional sensors for measuring temperature as well as relative humidity are preferably utilized in order to ensure the most reliable fire detection possible. It is also conceivable for early fire recognition to utilize an aspirating fire detection system in the target area which continuously extracts air samples from the target area and feeds them to a sensor for detecting fire parameters. Thus, with the help of suitable and known per se sensors, temperature measurements, fume and/or inert gas analyses as well as visibility determinations can in particular be made of the target area in order to detect a potential fire in a target area as early as possible. In combination with the device according to the invention, this is particularly advantageous for the reason that lowering the oxygen content in the target area can hence begin right at the moment of early fire detection, in order to be able to thus begin the initial flooding of the target area as early as possible. The combination of early fire detection with the inventive method also proves of particular advantage, because a flooding can be initiated up to several minutes earlier than is the case with conventional fire detection. Of course, other embodiments for early fire detection are also just as conceivable here.

The following will make reference to the drawings in describing preferred embodiments of the inventive inerting method for extinguishing a fire in a target area in greater detail.

Figure 2:
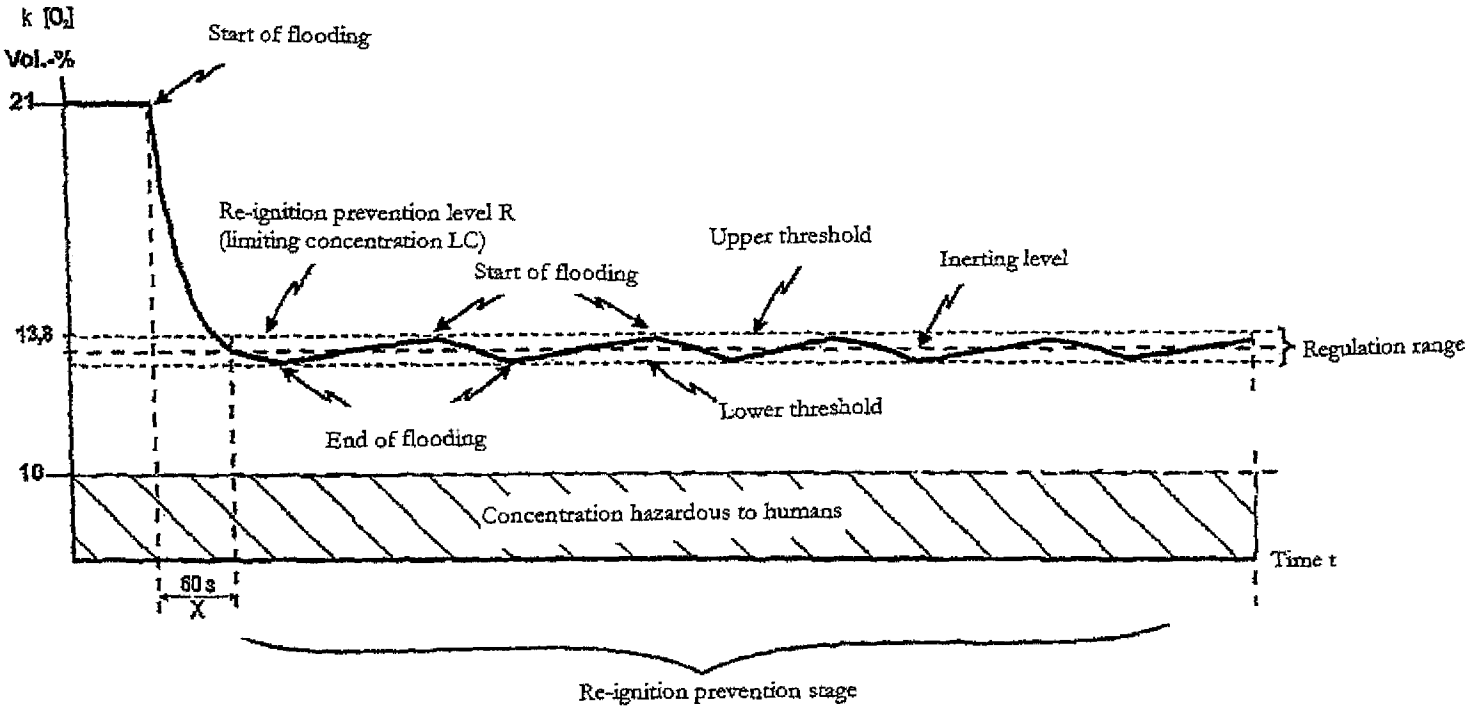
Figure 3:
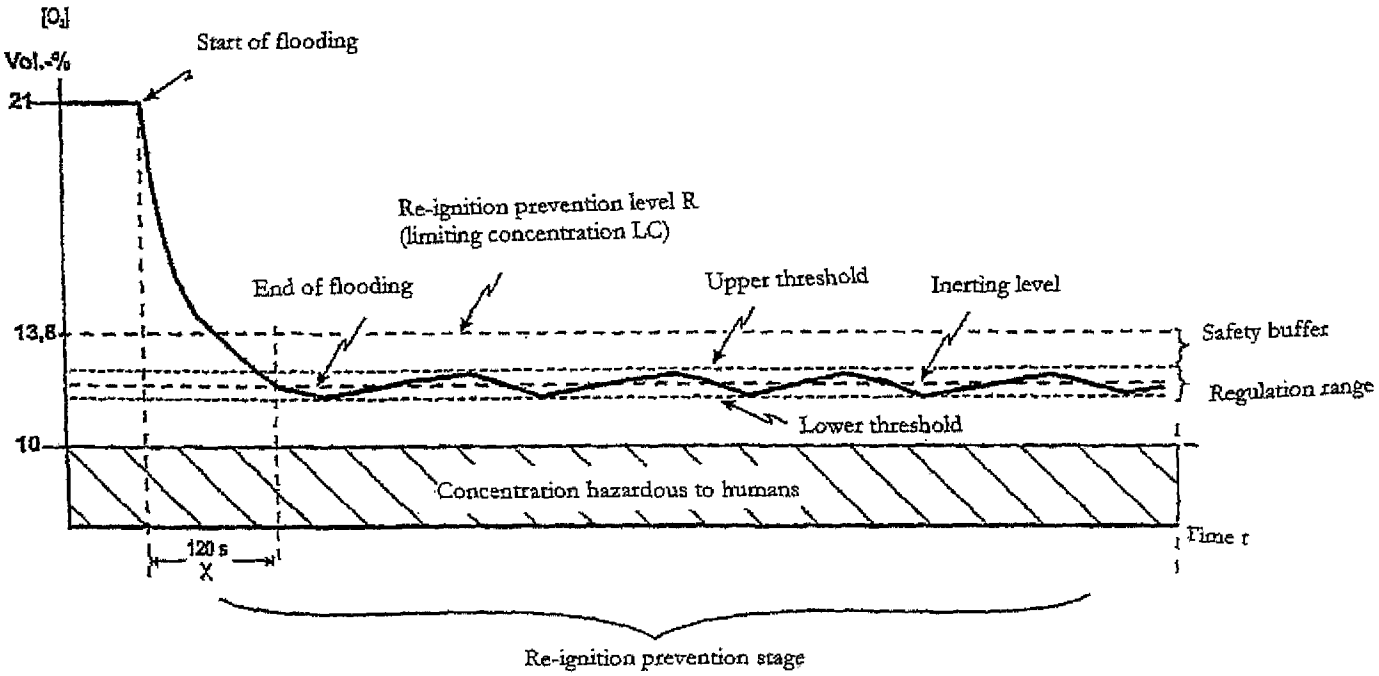
Figure 4:
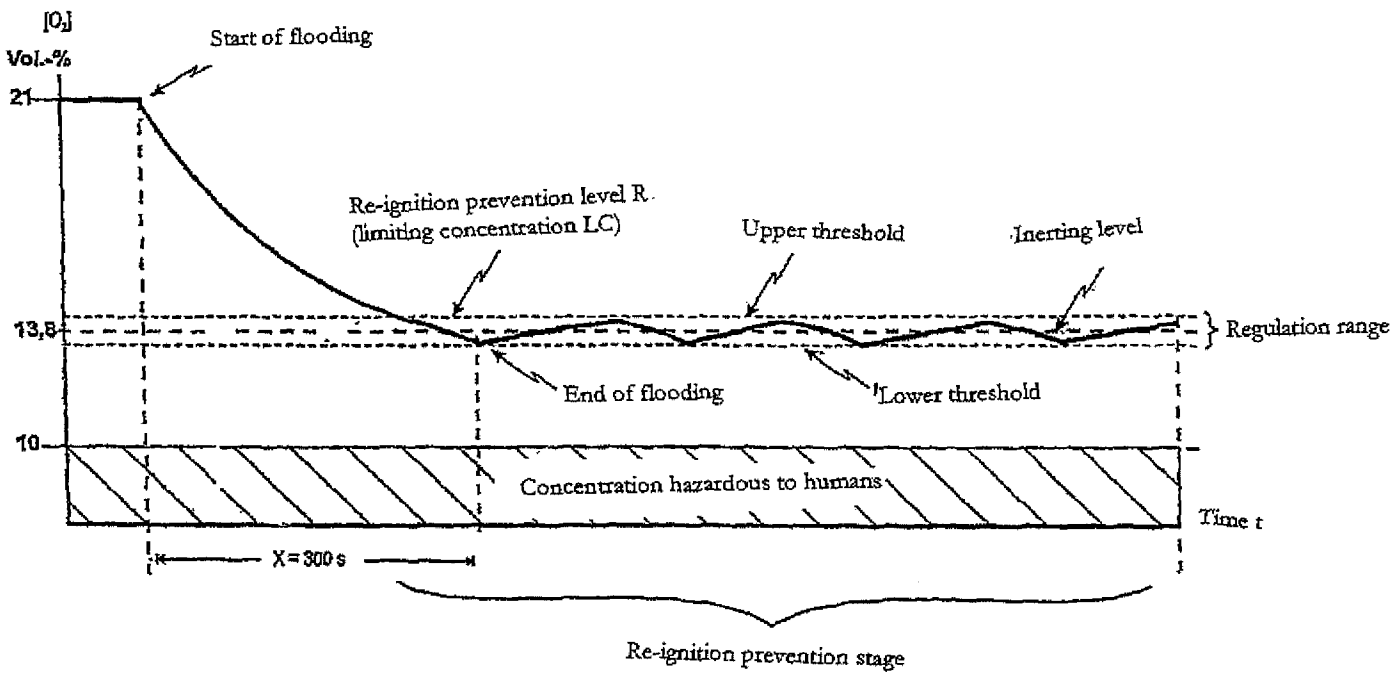
Figure 5:
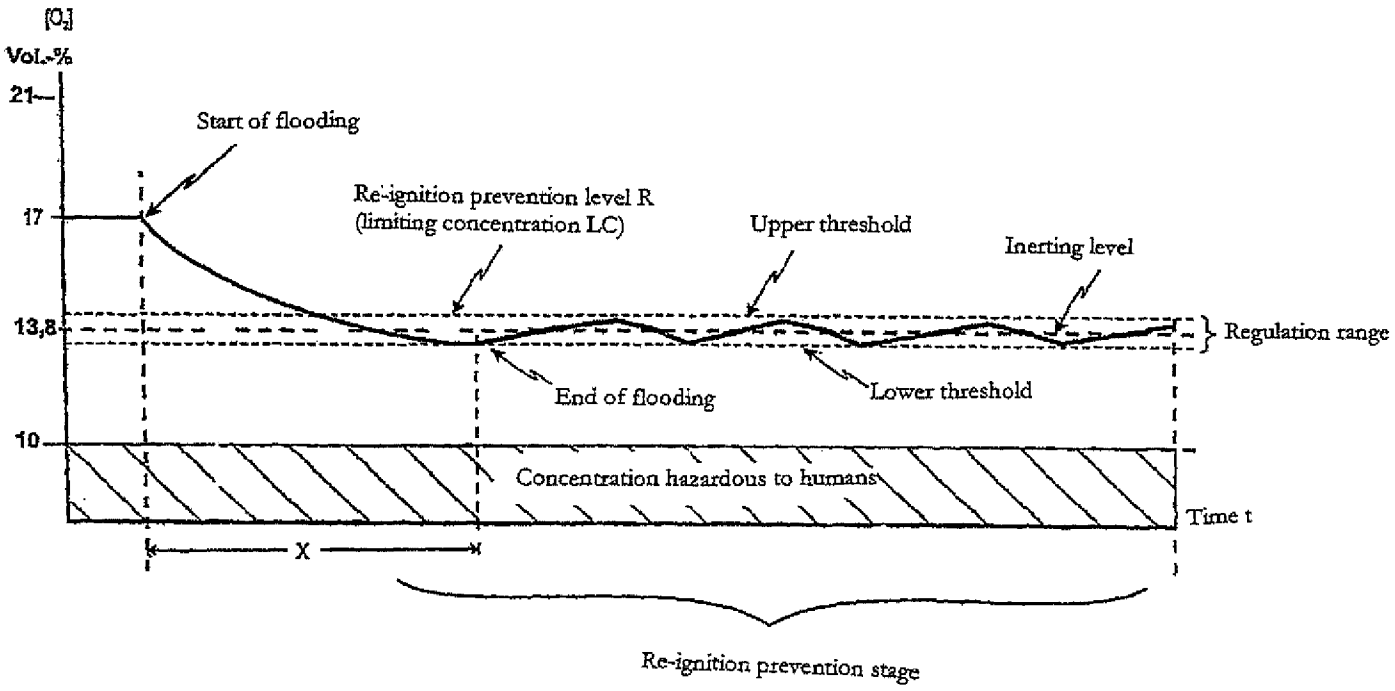
Figure 6:
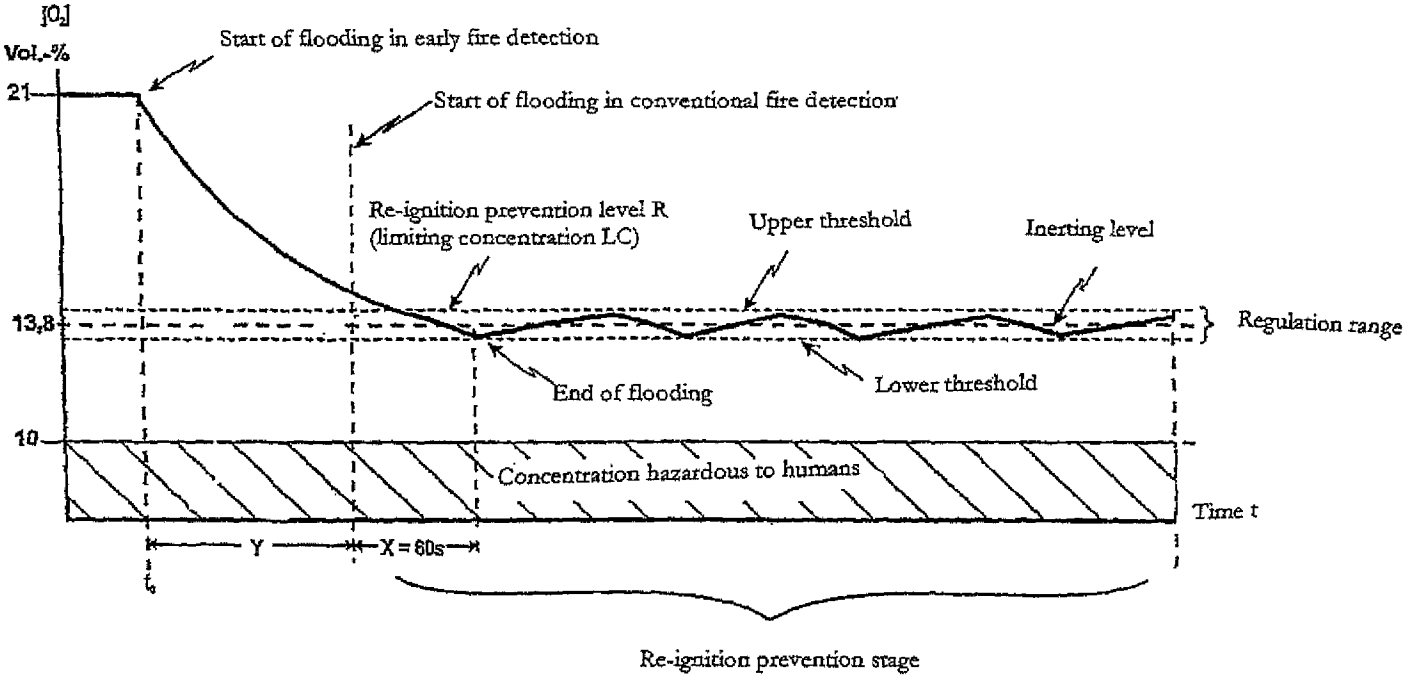

Shown are:

FIG. 1 a target area flooding profile from a prior art inerting method;

FIG. 2 a target area flooding profile from a first preferred embodiment of the inventive inerting method;

FIG. 3 a target area flooding profile from a second preferred embodiment of the inventive inerting method;

FIG. 4 a target area flooding profile from a third preferred embodiment of the inventive inerting method;

FIG. 5 a target area flooding profile from a fourth embodiment of the inventive inerting method; and FIG. 6 a target area flooding profile from a further embodiment of the inventive inerting method.

FIG. 1 shows the flooding profile in a target area with an inerting method known from the prior art. The process of extinguishing a fire is a three-stage process here. In the first stage, fire is detected in the target area and the inert gas fire-extinguishing system is activated. Power to the target area, for example the power supply, is furthermore switched off. Actually fighting the fire takes place subsequent the first stage in the fire-fighting stage, during which the target area is flooded with inert gas. In the FIG. 1 diagram, the y-axis represents the oxygen concentration in the target area and the x-axis represents the time. Accordingly, the introduction of the oxygen-displacing gas into the target area takes place within the first 240 seconds, until the inerting level of the inert gas fire-extinguishing system reaches the extinguishing concentration in this case of 11.2% by volume. The flooding profile is hereby defined such that the oxygen concentration in the target area reaches the re-ignition prevention level of in this case 13.8% by volume as soon as 60 seconds after the inerting method has been triggered; the re-ignition prevention level is also known as the limiting concentration (LC). This re-ignition prevention level is the oxygen concentration at which a re-igniting of the flammable materials accommodated within the target area is effectively prevented. Hence, in the present case, the re-ignition prevention level is at 13.8% oxygen by volume.

After the extinguishing concentration has been reached (11.2% by volume), the so-called re-ignition prevention stage begins, in which no further inert gas is introduced into the target area. The re-ignition prevention stage is in this case a period lasting 600 seconds during which at no time does the oxygen concentration in the target area exceed the re-ignition prevention level.

As the curve profile of FIG. 1 makes clear, the inerting method according to the prior art achieves compliance with the re-ignition prevention stage by the fact that the extinguishing concentration is set accordingly low. Since no further inert gas is introduced into the target area during the re-ignition prevention stage, the oxygen concentration increases continuously until the re-ignition prevention level of 13.8% by volume is first exceeded and ultimately the initial level of 21% by volume is reached (not explicitly depicted). As especially inferred from the flooding profile depicted in FIG. 1, an increased quantity of extinguishing agent is required in order to keep the oxygen concentration in the target area during the re-ignition prevention stage below the re-ignition prevention level. In the present case, this excessive amount of extinguishing agent corresponds to the spread between the re-ignition prevention level of 13.8% by volume and the flooding profile, the curve profile to the oxygen concentration in the target area respectively.

FIG. 2 shows a flooding profile in the target area from FIG. 1 in a first preferred embodiment of the inventive inerting method. The difference between the flooding profile depicted here, the temporal course of the oxygen concentration in the target area respectively, and the flooding profile as shown in FIG. 1 is especially to be seen in there no longer being an actual differentiation between a fire-fighting stage and a re-ignition prevention stage. After the inerting method having been triggered, the oxygen concentration in the target area is reduced to the inerting level within 60 seconds by flooding with inert gas. After the inerting level has been reached, that being 13.8% by volume here, the inert gas feed is curbed and then stopped completely after the oxygen concentration reaches a lower threshold within a regulation range near the inerting level. In the further course of the process, the oxygen concentration then rises continuously due to, for example, target area porosity, until reaching an upper oxygen content threshold within the regulation range. This upper threshold corresponds to the re-ignition prevention level, the target area's limiting concentration (LC) respectively. It is thus guaranteed that at no time does the target area oxygen concentration exceed the critical limiting concentration, the re-ignition prevention level respectively.

The inerting method according to the first embodiment of the present invention then provides for reintroducing inert gas back into the target area once the upper threshold has been reached in order to lower the oxygen concentration back down again to a lower threshold of the regulation range. After reaching the lower threshold, the inert gas feed into the target area is again stopped. Thus, the inerting level is iteratively kept to the re-ignition prevention level within a specific regulation range. The hold-time is wholly arbitrary. Re-ignition can be reliably prevented, even if the power supply has not been switched off.

In the present case, the upper limit of the regulation range for the inerting level is identical to the re-ignition prevention level of 13.8% by volume. The amplitude of the oxygen content in the regulation range hereby corresponds to a height of 0.2% by volume. In the flooding profile depicted in FIG. 2, the inerting level is reached after the definable time of 60 seconds. Of course, a different interval is also conceivable here.

At the beginning of flooding, the oxygen concentration k in the target area can amount to 21% by volume or less. For example, in order to reduce the risk of a fire, the target area can be subject to a base inertization level of 17% by volume.

The inventive maintaining of the inerting level at the re-ignition prevention level allows substantially less extinguishing agent to be required than is the case in a conventional inerting procedure.

It is furthermore possible with the inventive inerting method to regulate the oxygen content to the re-ignition prevention level in consideration of the target area's $n_{50}$ air exchange rate. As can be noted from FIG. 2, the oxygen concentration set in the target area by means of the inventive inerting method is in principle clearly higher than the 10% by volume concentration which is hazardous to humans. This is a further substantial advantage of the inerting method according to the invention.

FIG. 3 shows a flooding profile in a second preferred embodiment of the inventive inerting method. The difference between this flooding profile and the flooding profile depicted in FIG. 2 is that the inerting level is now lower than the re-ignition prevention level. Thus a further safety and/or safety buffer is provided between the upper limit, upper threshold of the regulation range respectively, and the re-ignition prevention level.

FIG. 4 shows a flooding profile in a further preferred embodiment of the inventive inerting method. The difference between the flooding profile according to FIG. 4 and the flooding profile depicted in FIG. 2 of the first preferred embodiment of the inventive inerting method is that the inert gas profile curve; i.e. the lowering of the target area's oxygen content when inerting begins, exhibits a clearly lower slope, the inerting level hereby being reached later. With the third embodiment, the lowering ensues in accordance with the invention by a regulating of the oxygen-displacing gas feed subject to the target area's air/gas pressure so as to thus avoid inflating the target area. This is especially suitable for target areas which do not have fixed walls or in which no pressure relief valves can be installed.

FIG. 5 shows a flooding profile in a fourth preferred embodiment of the inventive inerting method. The difference between the flooding profile according to FIG. 5 and the flooding profile depicted in FIG. 4 is that at the beginning of flooding, the oxygen concentration in the target area is already reduced to a base inertization level of e.g. 17% by volume. This is particularly advantageous since a lower quantity of extinguishing agent is sufficient in order to reach the re-ignition prevention level R. With the fourth embodiment, the lowering ensues in accordance with the invention by regulating the oxygen-displacing gas feed subject to the base inertization level at the beginning of the flooding. For example, the time x prior to reaching the re-ignition prevention level can be set shorter with a lower base inertization level than with a higher base inertization level. FIG. 6 shows a flooding profile in a further embodiment of the inventive inerting method. The difference between the flooding profile according to FIG. 6 and the flooding profile depicted in FIG. 2 is the earlier commencement of the flooding. With the help of early fire detection, for example, a highly-sensitive aspirating fire detection mechanism, the flow can be introduced up to several minutes earlier than is the case with conventional fire detection. This gained time y can then be used to introduced the extinguishing agent slow enough into the area that pressure relief valves become superfluous.

The method according to the invention presupposes a permanent monitoring of the oxygen content in the target area. In doing so, the appropriate sensors continuously detect the target area's oxygen concentration, inert gas concentration respectively and supply a control for the inert gas fire-extinguishing system which in response thereto controls the feed of extinguishing agent into the target area.

It is of course obvious that the method according to the invention is also applicable to a multi-stage inerting method. It is thereby conceivable to utilize the method according to the invention either in one individual stage or in all stages of the multi-stage inerting method.

I claim:

1. Inerting method for extinguishing a fire in a closed room ("target area") in which an oxygen content in the closed room is reduced within a given time (x) to a specific inerting level, wherein:

said inerting level is kept to a certain level within a given regulation range;

said inerting level corresponds to a re-ignition prevention level (R);

an upper end of said regulation range limited by an upper threshold of oxygen content and a lower end of said regulation range limited by a lower threshold of oxygen content;

said upper threshold of oxygen content in the regulation range is smaller than or, at maximum, equal to said re-ignition prevention level (R);

the time (x) for lowering the oxygen content to said inerting level is preset;

the time (x) for lowering the oxygen content to said inerting level is selected depending on an oxygen content in the closed room at a time a flooding begins for lowering the oxygen content to said inerting level; and said lower threshold of oxygen content in the regulation range is higher than an upper oxygen content limit which is hazardous to humans.

2. Inciting method in accordance with claim 1, wherein an amplitude of the oxygen content in the regulation range has a height of approximately 0.2% by volume.

3. Inerting method in accordance with claim 1, wherein the regulating of said oxygen content for lowering said oxygen content to said inerting level and/or for keeping said oxygen content at said re-ignition prevention level (R) is performed by taking into account said air exchange rate of the target area and/or a pressure difference between the target area and the environment.

4. Inerting method in accordance with claim 2, wherein the regulating of said oxygen content for lowering said oxygen content to said inerting level and/or for keeping said oxygen content at said re-ignition prevention level (R) is performed by taking into account an air exchange rate of the target area and/or a pressure difference between the target area and the environment.

5. Inerting method in accordance with claim 1, wherein a calculating of an amount of extinguishing agent for lowering said oxygen content to said inerting level and/or for keeping said oxygen content at said re-ignition prevention level (R) is performed by taking into account an air exchange rate of the target area and/or a pressure difference between the target area and the environment.

6. Inerting method in accordance with claim 3, wherein a calculating of an amount of extinguishing agent for lowering said oxygen content to the inerting level and/or for keeping said oxygen content at said re-ignition prevention level (R) is performed by taking into account the air exchange rate of the target area and/or the pressure difference between the target area and the environment.

7. Inerting method in accordance with claim 3, wherein the air exchange rate of the target area corresponds to an $n_{50}$ value of the target area.

8. Inerting method in accordance with claim 1 in which lowering said oxygen content ensues by means of feeding an oxygen-displacing gas into the target area, wherein a regulating of a supply of the oxygen-displacing gas is performed by taking into account an air/gas pressure in the target area.

9. Inciting method in accordance with claim 3 in which lowering said oxygen content ensues by means of feeding an oxygen-displacing gas into the target area, wherein a regulating of a supply of the oxygen-displacing gas is performed by taking into account an air/gas pressure in the target area.

10. Inerting method in accordance with claim 1 in which lowering said oxygen content ensues by means of feeding an oxygen-displacing gas into the target area, wherein a regulating of a supply of the oxygen-displacing gas for lowering the oxygen content to said inciting level and/or for maintaining said oxygen content is performed by taking into account the base inertization level at the time the flooding begins.

11. Inerting method in accordance with claim 1 in which lowering said oxygen content ensues by means of feeding an oxygen-displacing gas into the target area wherein a regulating of a supply of the oxygen-displacing gas is performed by taking into account either said current oxygen content or the current oxygen-displacing gas concentration, in the target area.

12. Inerting method in accordance with claim 1 in which lowering said oxygen content ensues by means of feeding an oxygen-displacing gas into the target area, wherein a regulating of a supply of the oxygen-displacing gas is performed by taking into account said oxygen content prior to beginning the lowering of said oxygen content to the specific inciting level.

13. Inerting method in accordance with claim 8, wherein the regulating of the supply of the oxygen-displacing gas is performed according to a specific flooding progress pattern.

14. Inerting method in accordance with claim 1, wherein said oxygen content in the target area is lowered by introduction of an oxygen-displacing gas from a reservoir.

15. Inerting method in accordance with claim 1 in which an oxygen-displacing gas is made available by means of a production system.

16. Inerting method in accordance with claim 1, wherein an oxygen-displacing gas for lowering said oxygen content to the specific inerting level is provided from a reservoir and the oxygen-displacing gas to keep the inerting level at said re-ignition prevention level (R) is provided from a production system.

17. Inerting method in accordance with claim 1, wherein said re-ignition prevention level (R) is determined by taking into account a characteristic fire load of the target area, especially dependent on a material present within the target area.

18. Inerting method in accordance with claim 1, wherein said re-ignition prevention level (R) is determined by taking into account any given equipment and/or machines present within the target area and their operating states.

19. Inerting method in accordance with claim 1, wherein any given equipment and/or machines present within the target area are brought into a pre-defined operational state prior to lowering said oxygen content to said specific inerting level.

20. Inerting method in accordance with claim 1 in which the lowering of said oxygen content in the target room begins at Time $t_0$ of an early fire detection.

* * * * *